US006853136B2

(12) United States Patent
Kim et al.

(10) Patent No.: US 6,853,136 B2
(45) Date of Patent: Feb. 8, 2005

(54) PLASMA DISPLAY PANEL HAVING DELTA DISCHARGE CELL ARRANGEMENT

(75) Inventors: Yong-Jun Kim, Suwon (KR); Cha-Keun Yoon, Seoul (KR); Jeong-Hyun Seo, Seoul (KR); Min-Sun Yoo, Cheonan (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 10/198,797

(22) Filed: Jul. 18, 2002

(65) Prior Publication Data

US 2003/0034734 A1 Feb. 20, 2003

(30) Foreign Application Priority Data

Aug. 20, 2001 (KR) ..... 2001-0050081
Oct. 19, 2001 (KR) ..... 2001-0064767

(51) Int. Cl.[7] ..... H01J 17/49

(52) U.S. Cl. ..... 313/582; 313/583; 313/584; 313/585; 313/586; 313/587

(58) Field of Search ..... 313/582–587

(56) References Cited

U.S. PATENT DOCUMENTS 5,182,489 A 1/1993 Sano
6,373,195 B1 * 4/2002 Whang et al. ..... 315/169.3

FOREIGN PATENT DOCUMENTS

JP 03-190039 8/1991
JP 10-092326 4/1998
JP 2000-011899 1/2000

OTHER PUBLICATIONS

Patent Abstract of Japan, Publication No. 10–092326, Published Apr. 10, 1998 in the name of Amamya Kimio.
Patent Abstracts of Japan for Publication No: 03–190039, Publication Date: Aug. 20, 1991.
Patent Abstracts of Japan for Publication No. 2000–011899, Publication Date: Jan. 14, 2000.

* cited by examiner

*Primary Examiner*—Alan Cariaso
*Assistant Examiner*—Sumati Krishnan
(74) *Attorney, Agent, or Firm*—Christie, Parker & Hale, LLP

(57) ABSTRACT

A plasma display panel includes a first substrate and a second substrate, the first substrate and the second substrate being provided with a predetermined gap therebetween. Barrier ribs are formed in a non-striped pattern between the first substrate and the second substrate, the barrier ribs defining a plurality of discharge spaces. A plurality of address electrodes are formed on the first substrate along a direction (y), the address electrodes being formed within and outside discharge spaces. A plurality of sustain electrodes are formed on the second substrate along a direction (x), the sustain electrodes being formed within and outside discharge spaces. The address electrodes include large electrode portions provided within discharge spaces and small electrode portions provided outside the discharge spaces. If a width of large electrode portions is AW, a width of small electrode portions is Aw, and a distance between barrier ribs along direction (x) is D, AW is larger than Aw, and AW is 40–75% of D.

27 Claims, 11 Drawing Sheets

FIG..4C
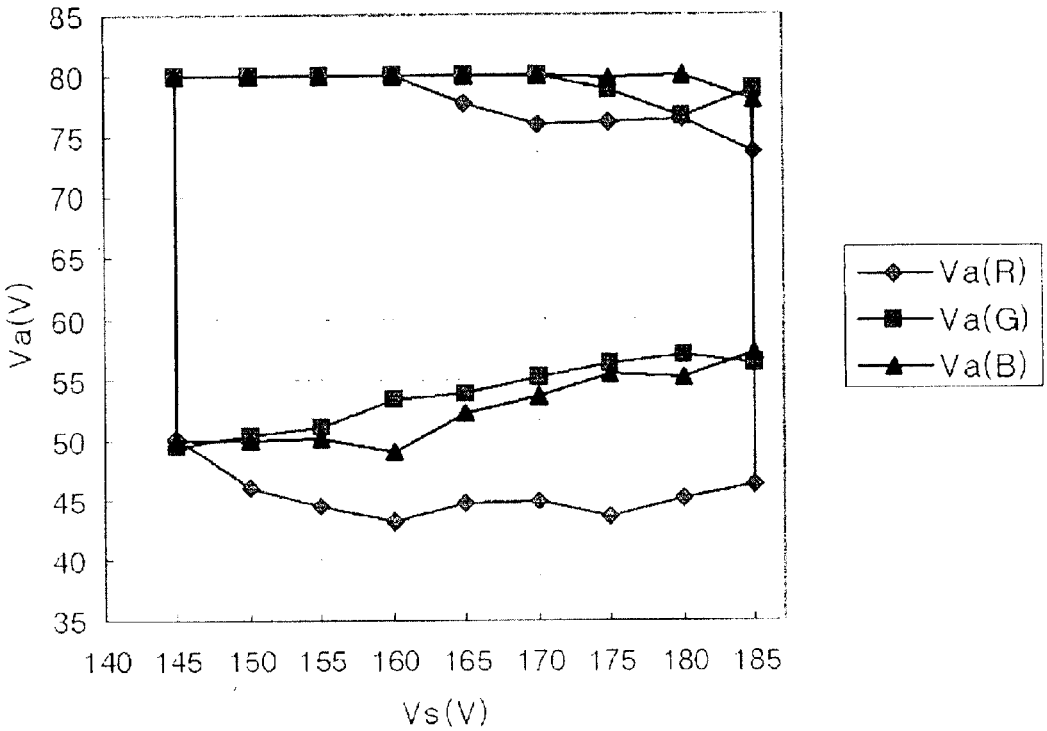

PLASMA DISPLAY PANEL HAVING DELTA DISCHARGE CELL ARRANGEMENT

CROSS-REFERENCE TO RELATED APPLICATIONS

This application claims priority to Korean Application Nos. 2001-50081, filed on Aug. 20, 2001 and 2001-64767, filed on Oct. 19, 2001 in Korean Patent Office, the entire disclosures of which are incorporated herein by reference.

FIELD OF THE INVENTION

The present invention relates to a plasma display panel, and more particularly, to a plasma display panel having a delta discharge cell arrangement, in which each set of R,G,B discharge cells is formed in a delta shaped configuration.

BACKGROUND OF THE INVENTION

A plasma display panel (PDP) is typically a display in which ultraviolet rays generated by the discharge of gas excites phosphors to realize predetermined images. As a result of the high resolution possible with PDPs, many believe that they will become a major, next generation flat panel display configuration.

The PDP is classified depending on how its discharge cells are arranged. Two main types of PDPs are: the stripe PDP, in which spaces where gas discharge takes place are arranged in a stripe pattern, and the delta PDP, in which each set of R,G,B discharge cells is arranged in a triangular (i.e., delta) shape.

In the conventional delta PDP, each set of R,G,B discharge cells is formed in a delta configuration between an upper substrate and a lower substrate. Sustain electrodes are formed on the upper substrate and address electrodes are formed on the lower substrate at locations corresponding to the positions of the discharge cells. A delta arrangement of each discharge cell is realized, for example, by barrier ribs of a quadrangle shape.

In such a delta PDP, an address voltage Va is applied between an address electrode and one of a pair of sustain electrodes that correspond to the selected discharge cell to perform addressing, and a discharge sustain voltage Vs is applied alternatingly to the sustain electrodes including a pair to perform sustaining. As a result, ultraviolet rays generated in the process of sustaining excite phosphors in the discharge cell such that phosphors emit visible light to thereby realize desired images.

The PDP disclosed in U.S. Pat. No. 5,182,489 is an example of such a delta PDP.

However, in conventional delta PDPs, including that disclosed in the above-reference patent, an address electrode corresponding to one of the discharge cells (for example, a G discharge cell) is provided under ribs defining other discharge cells (for example, R and B discharge cells). Such a structure is different from that found in typical PDPs. As a result, when addressing with respect to the G discharge cell, an address voltage applied to an address electrode affects a discharge state of the R and B discharge cells.

Therefore, in the delta PDP, a margin for the address voltage (i.e., the difference between an upper limit and lower limit for address voltage in order to maintain a stable discharge state for selected discharge cell) can not be made large, and the address voltage is restricted to a low upper limit such that it becomes difficult to drive the entire PDP.

Further, in the conventional delta PDP, the sustain electrodes are provided perpendicular to the address electrodes on barrier ribs in a simple line pattern while being positioned partly within each discharge cell by a predetermined amount. With such a formation of sustain electrodes, in addition to selected discharge cell, discharge occurs also in other discharge cells during addressing of address electrodes. This interferes with the stable addressing of a selected discharge cell such that driving of the entire PDP is made difficult.

The present invention has been made in an effort to solve the above-noted problems.

SUMMARY OF THE INVENTION

In accordance with the present invention, a plasma display panel is provided in which a discharge state of non-selected discharge cells is minimally affected when a selected discharge cell is driven, and an address voltage margin is increased to realize stable addressing.

The plasma display panel includes a first substrate and a second substrate, the first substrate and the second substrate being provided with a predetermined gap therebetween. Barrier ribs are formed in a non-striped pattern between the first substrate and the second substrate, the barrier ribs defining a plurality of discharge spaces. A plurality of address electrodes are formed on a first substrate along a direction (y), the address electrodes being formed within and outside discharge spaces. A plurality of sustain electrodes are formed on the second substrate along a direction (x), the sustain electrodes being formed within and outside discharge spaces. Address electrodes include large electrode portions provided within the discharge spaces and small electrode portions are provided outside the discharge spaces. If a width of the large electrode portions is AW, a width of the small electrode portions is Aw, a distance between the barrier ribs along direction (x) is D, then AW is larger than Aw and AW is 40–75% of D.

Each set of the R, G, and B discharge spaces formed by the barrier ribs may be arranged approximately in a triangular shape.

Each of the R, G, and B discharge spaces may be rectangular.

If widths of the large electrode portions of the address electrodes are $AW_R$, $AW_G$, and $AW_B$, $AW_R$, $AW_G$, and $AW_B$ may be different in size.

$AW_R$, $AW_G$, and $AW_B$ may satisfy the following condition:

$$AW_R<AW_G<AW_B.$$

The large electrode portions may be formed with circular or polygonal shape.

The sustain electrodes include main electrode portions formed following portions of barrier ribs provided along direction (x). Branch electrode portions formed extend from main electrode portions to be positioned within discharge spaces.

If widths of branch electrode portions positioned within the R, G, and B discharge spaces are $SW_R$, $SW_G$, and $SW_B$, $SW_R$, $SW_G$, and $SW_B$ may be different in size.

$SW_R$, $SW_G$, and $SW_B$ may satisfy the following condition:

$$SW_R<SW_G<SW_B.$$

If a width of the branch electrode portions provided within the discharge spaces is SW, the following condition may be satisfied:

$$AW=a\times SW(0<a\leqq 1).$$

(a) may satisfy the following condition:

$$0.5 \leqq a \leqq 1.$$

Also, the following condition may be satisfied:

$$AW = SW - b(0 \leqq b < SW).$$

(b) may satisfy the following condition:

$$0 \leqq b \leqq SW/2$$

The branch electrode portions may be formed with polygonal shape.

The branch electrode portions may include first electrode portions extending perpendicularly from the main electrode portions and second electrode portions that enlarge on a distal end of the first electrode portions extend parallel to the main electrode portions.

The branch electrode portions may include a pair of first electrode portions that extend perpendicularly from the main electrode portions with a predetermined distance therebetween and the second electrode portions that extend from one of the pair of first electrode portions to the other of the pair of first electrode portions on distal ends of the same.

Two branch electrode portions may be uniformly provided within one discharge space with a predetermined gap therebetween.

BRIEF DESCRIPTION OF THE DRAWINGS

FIG. 4*b* and 4*c* show graphs illustrating measured address voltage margins for each pixel type in a comparative plasma display panel of present invention.

DETAILED DESCRIPTION OF THE INVENTION

Various embodiments of the present invention will now be described in detail with reference to the accompanying drawings.

Figure 1:
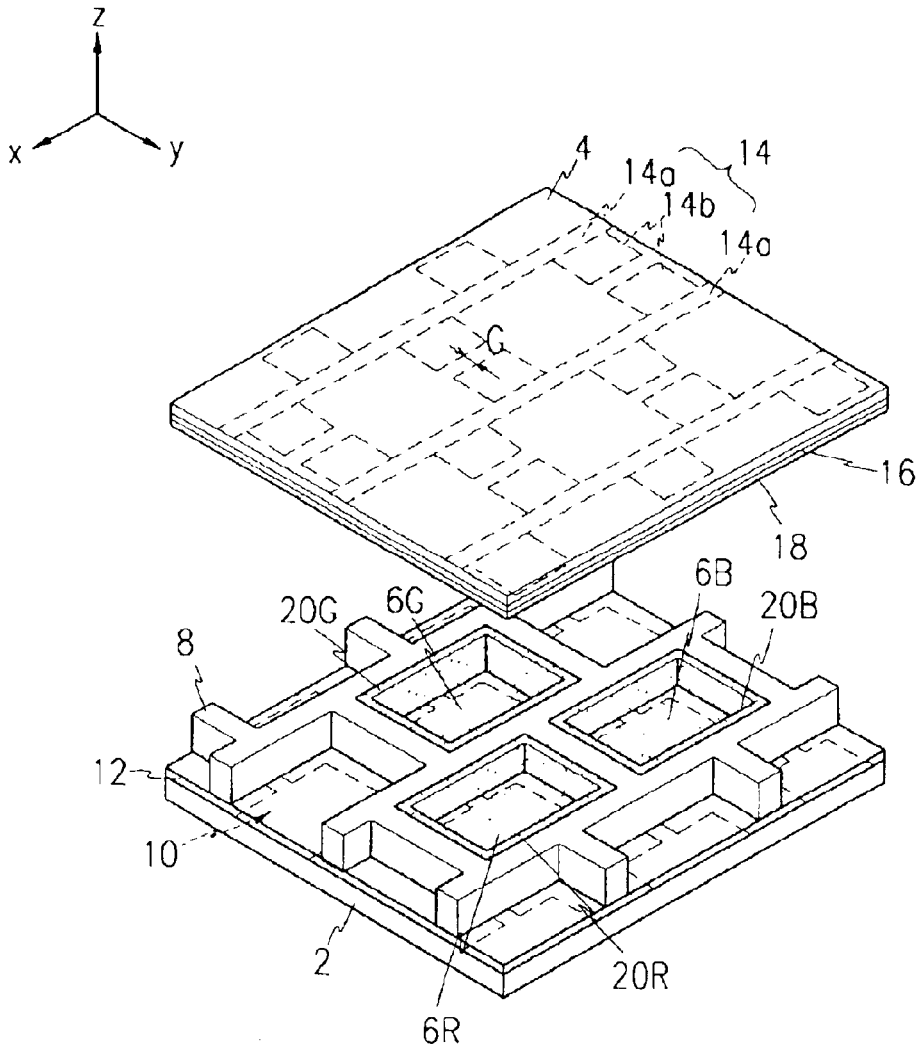
FIG. 1 is a partial exploded perspective view of a plasma display panel according to a first embodiment of present invention.
Figure 2:
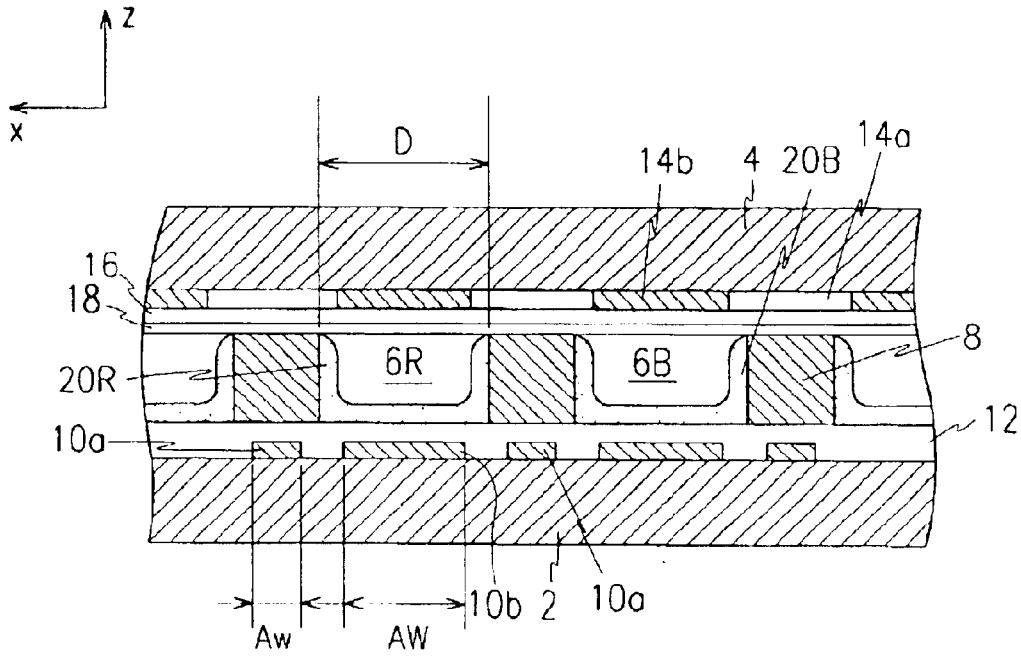
FIG. 2 is a partial sectional view of plasma display panel of FIG. 1 in a state where the plasma display panel is assembled.
Figure 3:
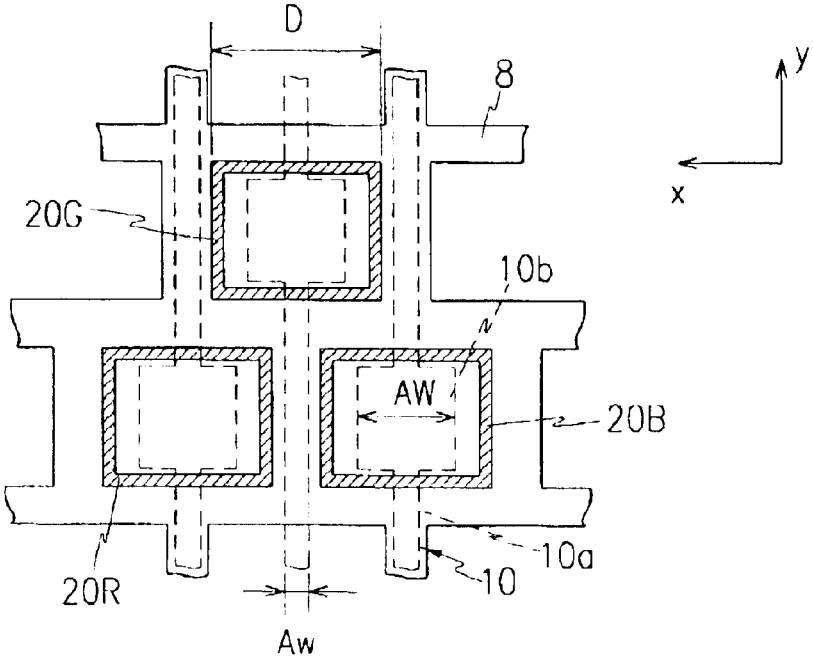
FIG. 3 is a partial plane view of a lower substrate of plasma display panel of FIG. 1.

FIG. 1 is a partial exploded perspective view of a plasma display panel according to a first embodiment of present invention. FIG. 2 is a partial sectional view of plasma display panel of FIG. 1 in a state where the plasma display panel is assembled.

In a plasma display panel (PDP) according to a first embodiment of present invention, a plurality of R,G,B discharge spaces are defined by sets of barrier ribs, each set forming substantially a triangular shape to realize a delta alternating current PDP. Each discharge space is independently controlled to realize predetermined images.

In more detail, the PDP includes a first substrate 2 (hereinafter referred to as a lower substrate) and a second substrate 4 (hereinafter referred to as an upper substrate). Lower substrate 2 and upper substrate 4 are provided substantially in parallel with a predetermined gap therebetween.

Barrier ribs 8 are provided at a predetermined height between lower substrate 2 and upper substrate 4 in a non-striped pattern. Barrier ribs 8 define a plurality of discharge spaces 6R, 6G, and 6B. In a first embodiment of the present invention, each set of discharge spaces 6R, 6G, and 6B is arranged substantially in a triangular shape, while each of the individual discharge spaces 6R, 6G, and 6B is formed in a rectangular shape.

A plurality of address electrodes 10 is formed on lower substrate 2 along direction (y). Address electrodes 10 are formed both within and outside of discharge spaces 6R, 6G, and 6B. Also, first dielectric layer 12 is formed over an entire surface of lower substrate 2 covering address electrodes 10.

In the first embodiment of present invention, address electrodes 10 include small electrode portions 10*a*, which are formed outside discharge spaces 6R, 6G, and 6B, that is, directly under portions of barrier ribs 8 extending along direction (y) and large electrode portions 10*b* formed within discharge spaces 6R, 6G, and 6B. Accordingly, the width of address electrodes 10 varies between small electrode portions 10*a* and large electrode portions 10*b*.

A plurality of sustain electrodes 14 is formed on upper substrate 4 along direction (x). Sustain electrodes 14 are formed at areas corresponding to both within and outside discharge spaces 6R, 6G, and 6B. That is, sustain electrodes 14 include main electrode portions 14*a*, which are positioned corresponding to portions of barrier ribs 8 extending along direction (x); and branch electrode portions 14*b*, which extend from main electrode portions 14*a* into areas corresponding to formation of discharge spaces 6R, 6G, and 6B. Within each discharge space 6R, 6G, and 6B, there are provided two branch electrode portions 14*b* from two main electrode portions 14*a* of different sustain electrodes 14. There is provided a predetermined discharge gap G between each pair of branch electrode portions 14*b* within each discharge space 6R, 6G, and 6B. In the first embodiment, the main electrode portions 14*a* are composed of an opaque material, like Ag metal, and the branch electrode portions 14*b* are composed of a transparent material, like Indium Tin Oxide (ITO).

Transparent second dielectric layer 16 is formed over an entire area of upper substrate 4 covering sustain electrodes 14. Also, protection layer 18 made of MgO is formed over second dielectric layer 16.

Phosphor layers 20R, 20G, and 20B are formed in discharge spaces 6R, 6G, and 6B, respectively. Phosphor layers 20R, 20G, and 20B cover first dielectric layer 12 and are formed extending up the side walls of barrier ribs 8.

In order to increase an address voltage margin, a width of address electrodes 10 is varied. With reference also to FIG.

3, which shows a partial plane view of lower substrate 2 of the plasma display panel of FIG. 1, a width AW of large electrode portions 10*b* of address electrodes 10 is greater than a width Aw of small electrode portions 10*a* of address electrodes 10. That is, large electrode portions 10*b* positioned within discharge spaces 6R, 6G, and 6B, have a width AW, while small electrode portions 10*a* positioned outside discharge spaces 6R, 6G, and 6B and under portions of barrier ribs 8 extending in direction (y) have a width Aw.

By changing the width of address electrodes 10 according to their position relative to barrier ribs 8 and discharge spaces 6R, 6G, and 6B, a discharge distribution in discharge spaces 6R, 6G, and 6B may be varied. That is, the more the width of large electrode portions 10*b* of address electrodes 10 is increased, the less an electric potential formed by small electrode portions 10*a* influences the discharge state of a non-selected discharge cell.

For example, to turn off a G pixel, a 70V voltage is applied to address electrode 10 passing through G discharge space 6G, and a 0V voltage is applied to address electrodes 10 passing through R discharge space 6R and B discharge space 6B. In contrast, in prior art PDPs, a potential distribution of address electrode passing under barrier rib between the R pixel and the B pixel to be positioned in G pixel greatly affects discharge states of the R and B pixels. In accordance with the present invention, using one set of R,G,B discharge spaces 6R, 6G, and 6B as an example, areas of large electrode portions 10*b* positioned in R discharge space 6R and B discharge space 6B is significantly larger than an area of small electrode portion 10*a* passing under barrier rib 8 between R and B discharge spaces 6R and 6B. As a result, the influence of a potential distribution formed by small electrode portion 10*a* on the discharge states of R and B discharge spaces 6R and 6B is minimized.

Therefore, the R pixels and B pixels can maintain more stable discharge states regardless of the ON/OFF states of an adjacent G pixel. This allows for an upper limit of the address voltage applied to each of address electrodes to be raised to thereby increase the address voltage margin.

Preferably, width AW of large electrode portions 10*b* positioned within discharge spaces 6R, 6G, and 6B is 40–75% of a width D of discharge spaces 6R, 6G, and 6B along direction (x) that is a distance between two parallel barrier ribs 8 that are positioned in direction (y).

Through experimentation, it was determined that if width AW of large electrode portions 10*b* is less than 40% of width of discharge spaces 6R, 6G, and 6B, the address voltage margin is insufficiently increased such that it is difficult to realize stable discharge conditions. Also, if width AW of large electrode portions 10*b* is greater than 75% of width of discharge spaces 6R, 6G, and 6B, there is an increased possibility of a short developing between small electrode portions 10*a* passing under barrier ribs 8 and large electrode portions 10*b* within discharge spaces 6R, 6G, and 6B.

Figure 4A:
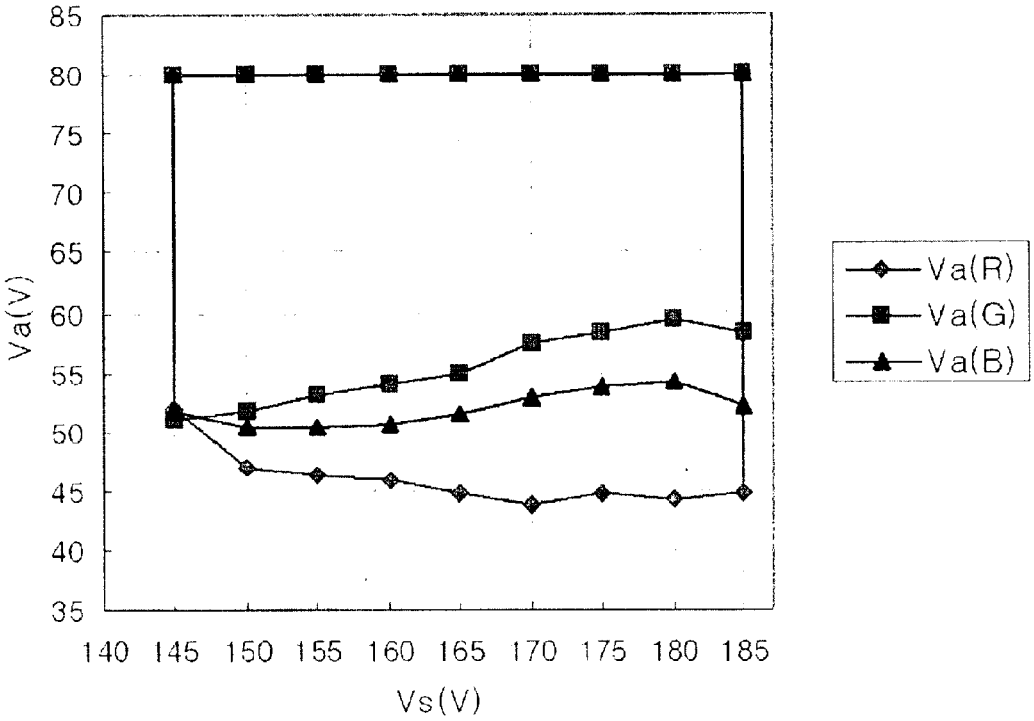
FIG. 4*a* shows graph illustrating measured address voltage margins for each pixel type in a plasma display panel of present invention.
Figure 4B:
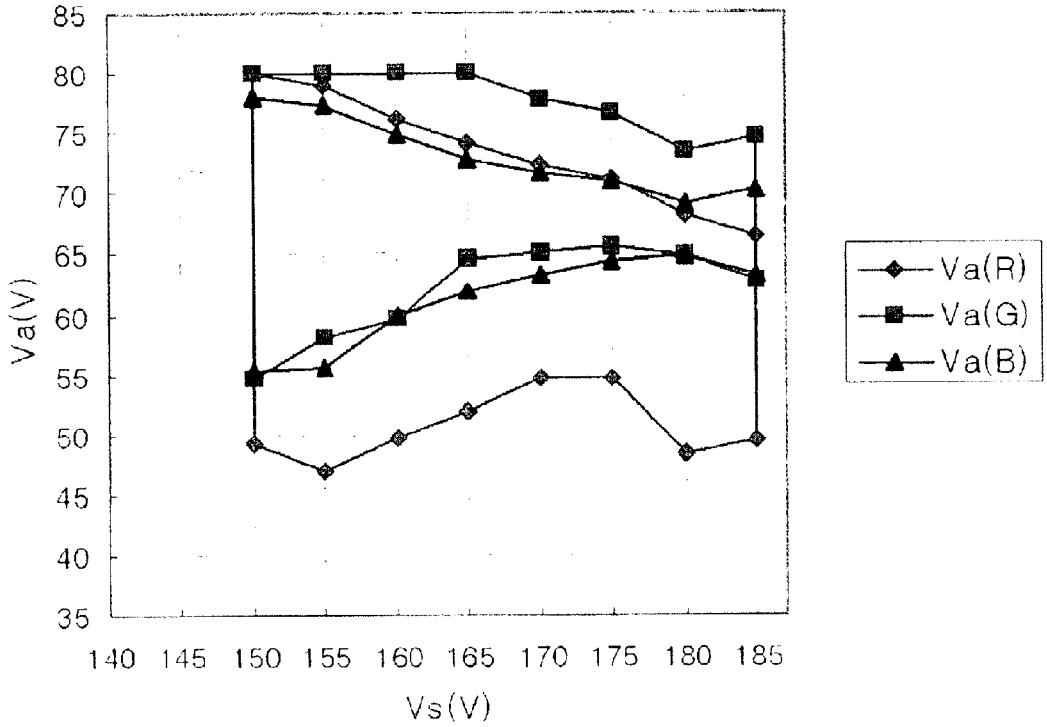

FIGS. 4*a*, 4*b*, and 4*c* show graphs illustrating measured address voltage Va margins with respect to sustain voltages Vs for the R,G,B pixels in the PDP of the present invention (FIG. 4*a*) and in the comparative PDPs (comparative examples, FIGS. 4*b* and 4*c*), respectively. In each of graphs of FIGS. 4*a*, 4*b* and 4*c*, the upper line represents the upper limit of the address voltage Va and the lower line represents the lower limit of the address voltage Va. The distance between the upper line and the lower line is the address voltage margin.

In both the present invention and the comparative examples, an R,G,B pixel size of 720×540 μm, that is, with a width D of 720 μm, was used. In the present invention, the width AW of the large electrode portion 10*b* of the address electrode 10 was 300 μm, and the width Aw of the small electrode portion 10*a* of the address electrode was 60 μm. On the other hand, in the PDPs used for the comparative examples, the large electrode portions of the address electrodes had widths of 100 μm and 200 μm, respectively.

As shown in graphs of FIGS. 4*a*, 4*b*, and 4*c*, the address voltage upper limit for the G pixel is increased in the PDP of present invention compared to the comparative PDPs. Address voltage lower limits are decreased in accordance with the present invention for each of the R, G, and B pixels when compared to the comparative PDPs. As a result, when compared to the comparative examples, the address voltage margin is effectively increased by approximately 30V pursuant to the present invention.

By increasing width AW of large electrode portion 10*b* of address electrode 10 that is positioned in discharge spaces 6R, 6G, and 6B, the brightness of pixels is increased. In actual application to a PDP, brightness ratios of the R, G, and B pixels must be suitably adjusted. In accordance with the present invention, brightness ratios are adjusted as described below.

Figure 5:
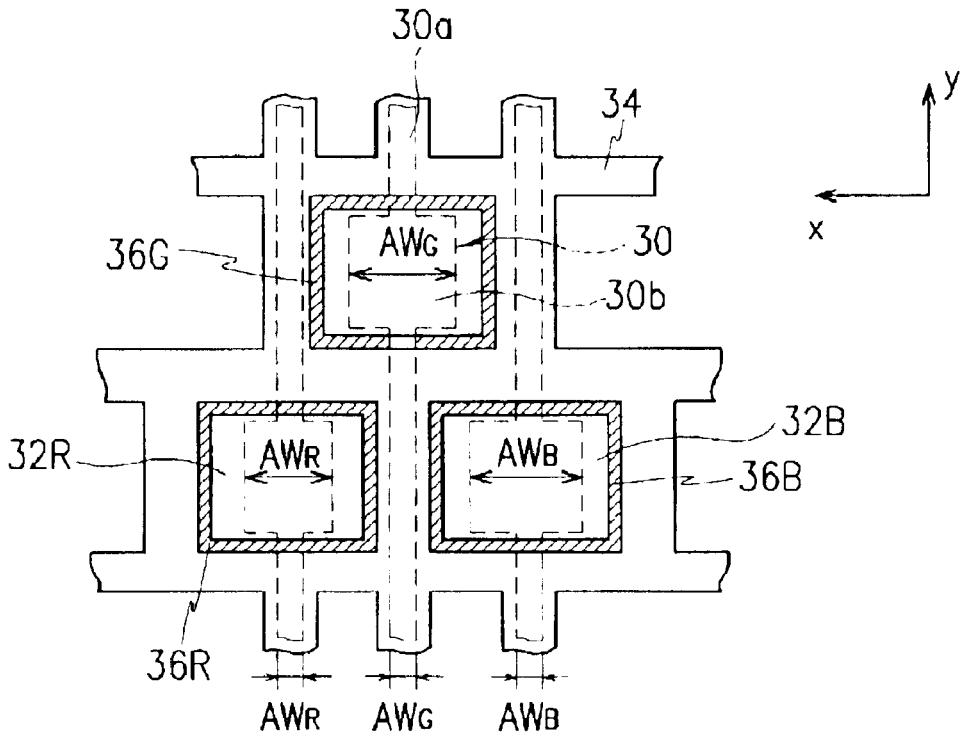
FIG. 5 is a partial plane view of a lower substrate of a plasma display panel according to a second embodiment of present invention.

FIG. 5 is a partial plane view of a lower substrate of a PDP according to a second embodiment of the present invention. In the PDP of the second embodiment of present invention, address electrodes 30 include large electrode portions 30*b* that are positioned in discharge spaces 32R, 32G, and 32B, and small electrode portions 30*a* that are positioned under barrier ribs 34 between discharge spaces 32R, 32G, and 32B. Large electrode portions 30*b* have widths $AW_R$, $AW_G$, and $AW_B$ that are greater than widths $AW_R$, $AW_G$, and $AW_B$ of small electrode portions 30*a*.

The widths $AW_R$, $AW_G$, and $AW_B$ are made different depending on light-emitting efficiencies of R, G, B phosphor layers 36R, 36G, and 36B. In the second embodiment of the present invention, widths $AW_R$, $AW_G$, and $AW_B$ of large electrode portions 30*b* for the R, G, and B pixels, respectively, satisfy the the following condition:

$$AW_R<AW_G<AW_B.$$

The reason that width $AW_B$ of large electrode portion 30*b* for the B pixel is made larger than widths $AW_R$ and $AW_G$ of large electrode portions 30*b* for the R pixel and the G pixel, respectively, is that the light-emitting efficiency of B phosphor layer 36B is lower than the light-emitting efficiencies of R and G phosphor layers 36R and 36G.

By varying the widths $AW_R$, $AW_G$, and $AW_B$ of large electrode portions 30*b*, the brightness ratio of the R, G, and B pixels can be easily adjusted. Further, if the above condition is satisfied for widths $AW_R$, $AW_G$, and $AW_B$ of large electrode portions 30*b*, the brightness ratio of the R, G, and B pixels can be improved.

Figure 6:
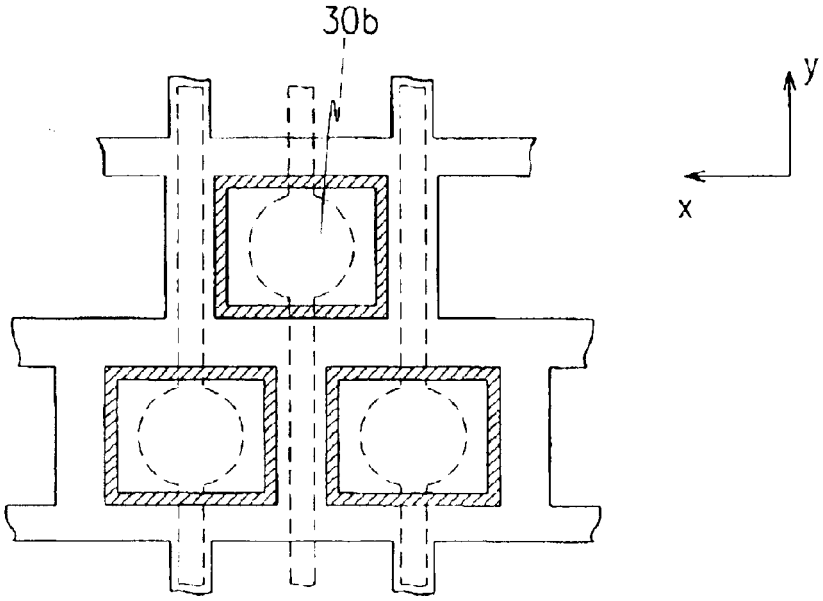
FIGS. 6 and 7 are partial plane views of a lower substrate of a plasma display panel showing different structural examples for address electrodes according to present invention.
Figure 7:
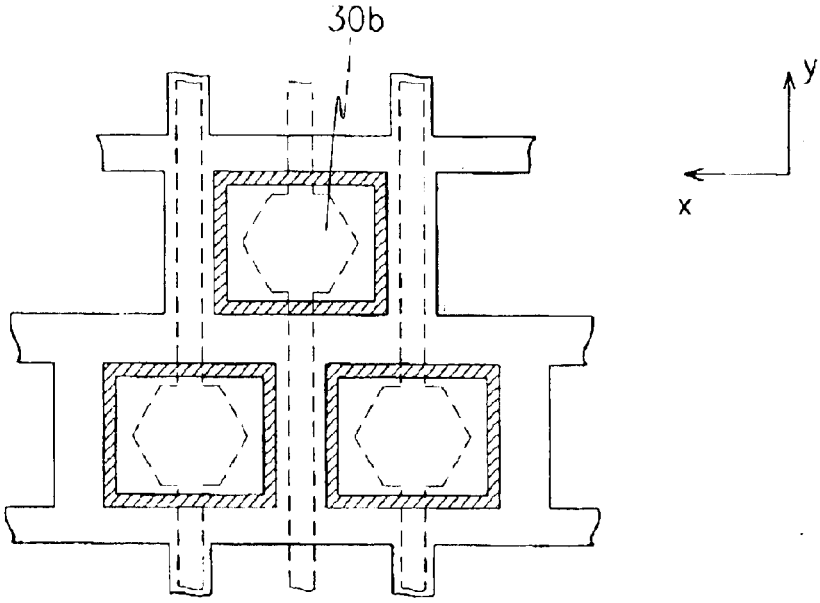

The shape of large electrode portions 30*b* of address electrodes 30 is not limited to a rectangular shape and can be formed in a circular shape as shown in FIG. 6, and various polygonal shapes such as a hexagonal shape as shown in FIG. 7.

Figure 8:
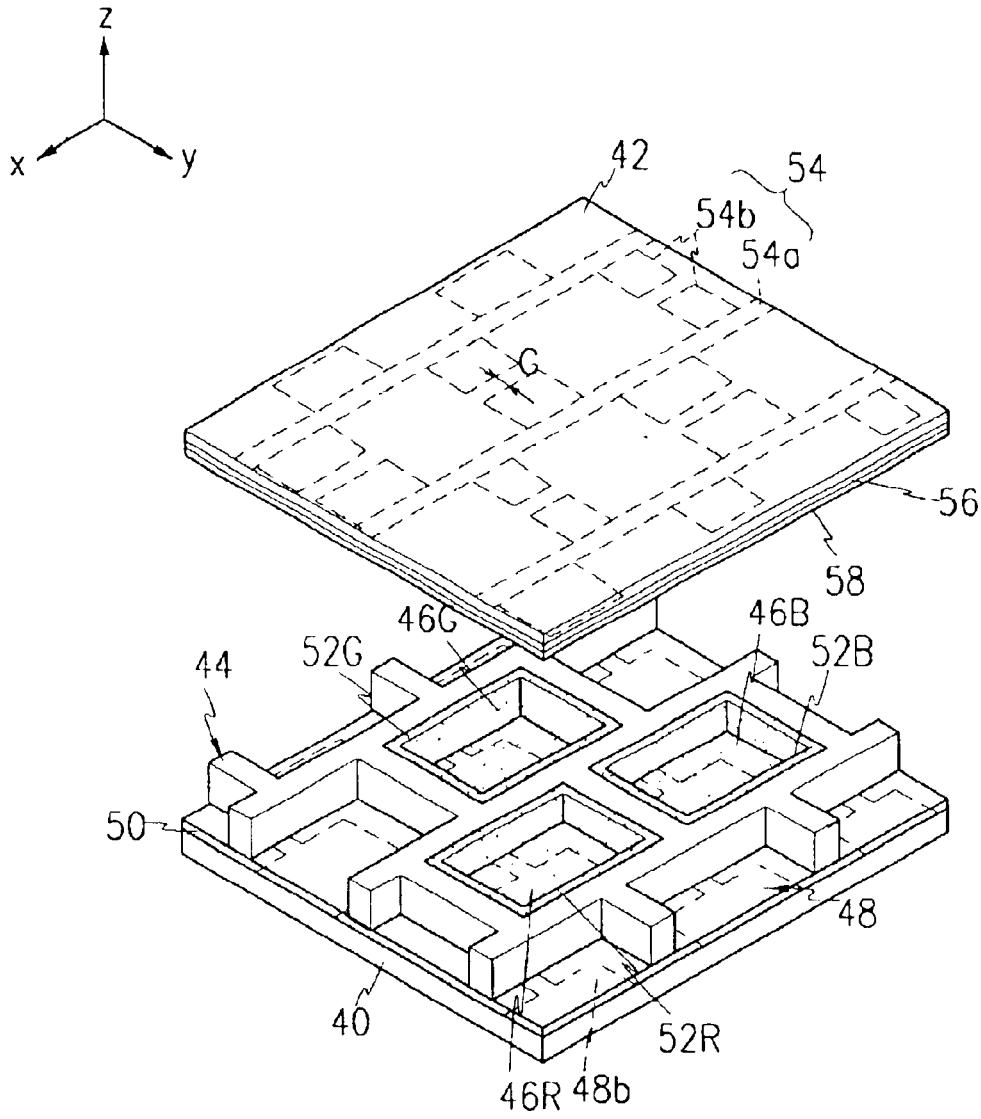
FIG. 8 is a partial exploded perspective view of a plasma display panel according to a third embodiment of present invention.
Figure 9:
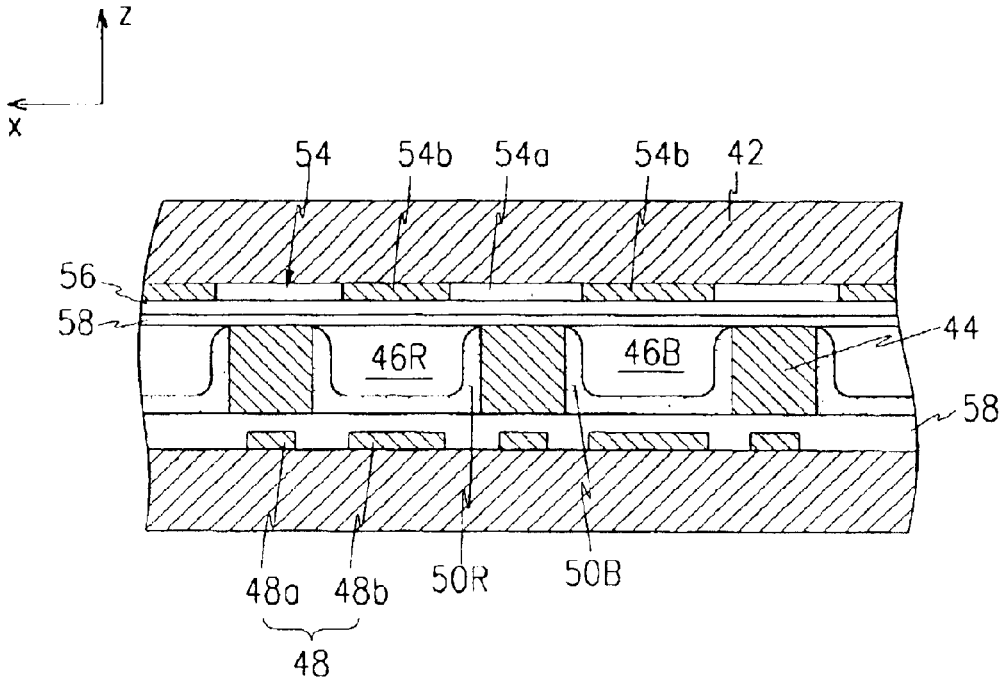
FIG. 9 is a partial sectional view of plasma display panel of FIG. 8 in a state where the plasma display panel is assembled.

FIG. 8 is a partial exploded perspective view of a PDP according to a third embodiment of the present invention. FIG. 9 is a partial sectional view of PDP of FIG. 8 in a state where the PDP is assembled. The basic structure of the PDP according to the third embodiment of the present invention is identical to that of the PDPs according to the first and second embodiments of the present invention. However, the structure of the sustain electrodes is changed to improve an address voltage margin.

In more detail, the PDP according to the third embodiment of the present invention includes first substrate 40 (hereinafter referred to as a lower substrate) and second substrate 42 (hereinafter referred to as an upper substrate). Lower substrate 40 and upper substrate 42 are provided substantially in parallel with a predetermined gap therebetween. As with the above embodiments, barrier ribs 44 are provided at a predetermined height between lower substrate 40 and upper substrate 42 to define a plurality of R, G, and B discharge spaces 46R, 46G, and 46B.

Further, identically as in the first and second embodiments, a plurality of address electrodes 48 having small electrode portions 48*a* and large electrode portions 48*b*, and first dielectric layer 50 are formed on lower substrate 40. Phosphor layers 52R, 52G, and 52B are formed in discharge spaces 46R, 46G, and 46B, respectively.

Also, formed on upper substrate 42, as in the first and second embodiments, are a plurality of sustain electrode 54 each having main electrode portion 54*a* and branch electrode portions 54*b*, second dielectric layer 56, and protection layer 58.

Figure 10:
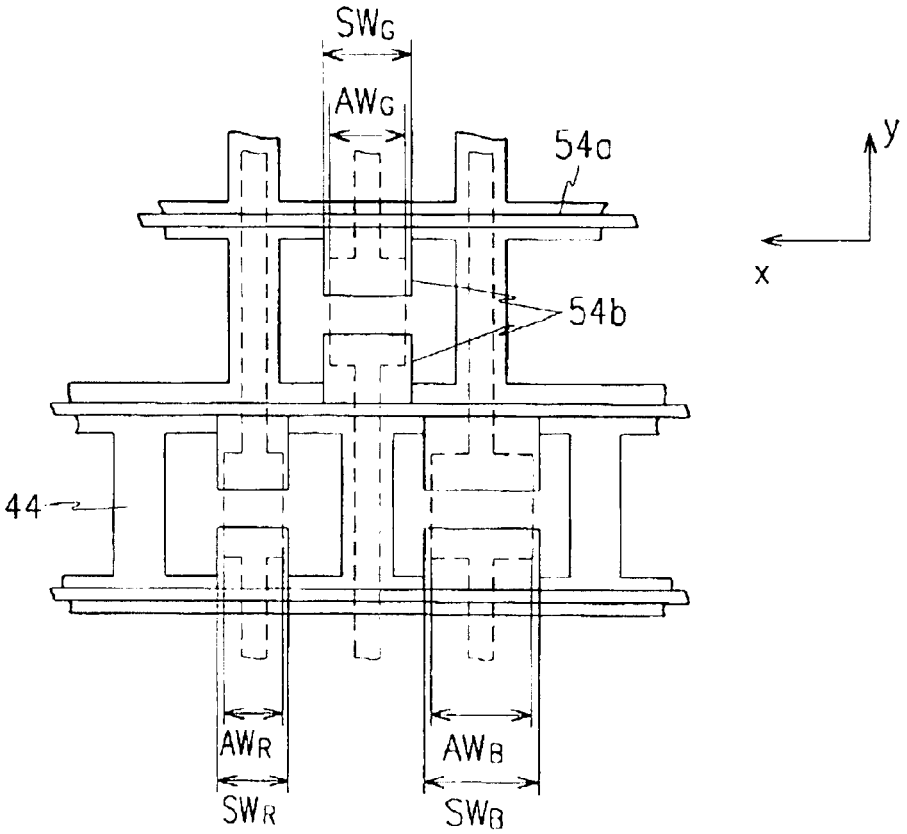
FIGS. 10, 11, and 12 are partial plane views showing different modification examples of the plasma display panel of FIG. 8.

The branch electrode portions 54*b* of sustain electrodes 54 are rectangular, and, as shown in FIG. 10, have different widths $SW_R$, $SW_G$, and $SW_B$ depending on inside which discharge space 46R, 46G, and 46B they are located. Widths $SW_R$, $SW_G$, and $SW_B$ of branch electrode portions 54*b* of sustain electrodes 54 satisfy the following condition:

$$SW_R<SW_G<SW_B$$

where $SW_R$ refers to the width of branch electrode portions 54*b* corresponding to R discharge space 46R; $SW_G$ refers to the width of branch electrode portions 54*b* corresponding to G discharge space 46G; and $SW_B$ refers to branch electrode portions 54*b* corresponding to B discharge space 46B.

In the third embodiment of the present invention, widths $SW_R$, $SW_G$, and $SW_B$ of branch electrode portions 54*b* of sustain electrodes 54 are made different in order to increase amount of ultraviolet rays generated. That is, increasing widths $SW_R$, $SW_G$, and $SW_B$ of branch electrode portions 54*b* raises a strength of sustain discharge, which, in turn, increases the amount of ultraviolet rays generated.

Accordingly, width $SW_B$ of branch electrode portion 54*b* for the B pixel, which has a substantially lower light-emitting efficiency for its phosphor layer than phosphor layers of other pixels, is made largest to increase the strength of its sustain discharge. Also, width $SW_R$ of branch electrode portion 54*b* for the R pixel, which has a substantially higher light-emitting efficiency for its phosphor layer than phosphor layer of other pixels, is made smallest to decrease the strength of its sustain discharge.

Further, in the third embodiment of the present invention, in order to increase the address voltage margin and to ensure stable addressing conditions, at least one of the following two conditions are satisfied, in which there is established a relation between widths SW of branch electrode portions 54*b* of sustain electrodes 54 and widths AW of large electrode portions 48*b* of address electrodes 48:

$$AW=a\times SW(0<a\leqq 1)$$

$$AW=SW-b(0\leqq b<SW)$$

In the third embodiment, widths AW of large electrode portions 48*b* of address electrodes 48 are not only made different according to which pixel large electrode portions 48*b* are located in as in the above embodiments, but are also varied in relation to widths SW of branch electrodes portion 54*b*. That is, width AW of large electrode portion 48*b* positioned in R discharge space 46R is either identical to or smaller than width $SW_R$ of corresponding branch electrode portion 54*b*. Width AW of large electrode portion 48*b* positioned in G discharge space 46G is either identical to or smaller than width $SW_G$ of corresponding branch electrode portion 54*b*. Width AW of large electrode portion 48*b* positioned in B discharge space 46B is either identical to or smaller than width $SW_B$ of corresponding branch electrode portion 54*b*.

However, widths AW of large electrode portions 48*b* must be at least ½ the widths SW of branch electrode portions 54*b* to realize addressing effects. Therefore, it is preferable that the value of (a) in the above conditions is greater than or equal to 0.5, and the value of (b) is less than SW/2.

In the PDP according to the third embodiment of the present invention, in addition to increasing the address voltage margin through large electrode portions 48*b* of address electrodes 48, branch electrode portions 54*b* of sustain electrodes 54 are formed in relation to large electrode portions 48*b* such that overlapping areas are optimized within one of the discharge spaces 46R, 46G, and 46B. This reduces the strength of a reset discharge so that a light emitting amount with respect to the reset discharge, that is, a reset brightness is decreased, and thereby realizes stabile addressing.

Modification examples of branch electrode portions of the third embodiment of the present invention will now be described.

Figure 11:
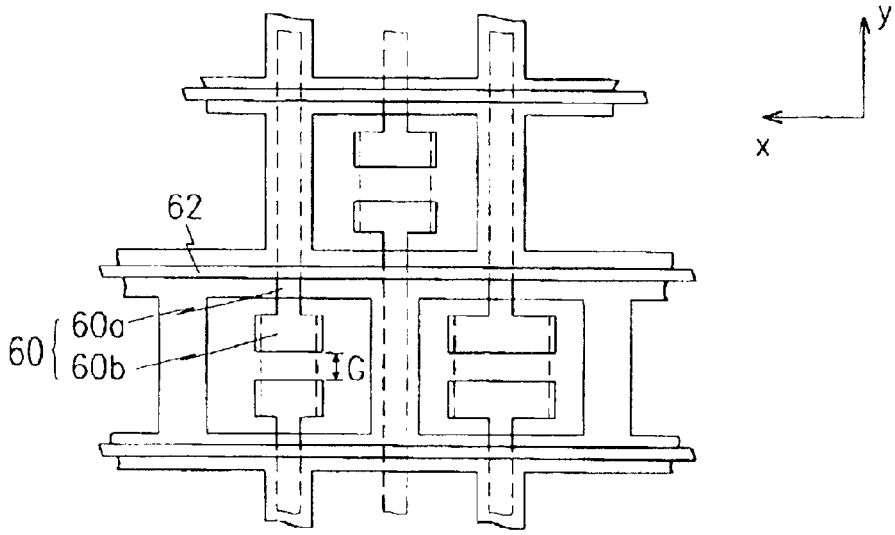

First, with reference to FIG. 11, branch electrode portions 60 include first electrode portion 60*a* that extends perpendicularly from main electrode portions 62, and second electrode portion 60*b* that enlarges on a distal end of first electrode portion 60*a* to extend parallel to main electrode portions 62. Within one discharge space, a gap G is formed between two second electrode portions 60*b* extending into discharge space from opposite directions, that is, from two different main electrode portions 62.

Figure 12:
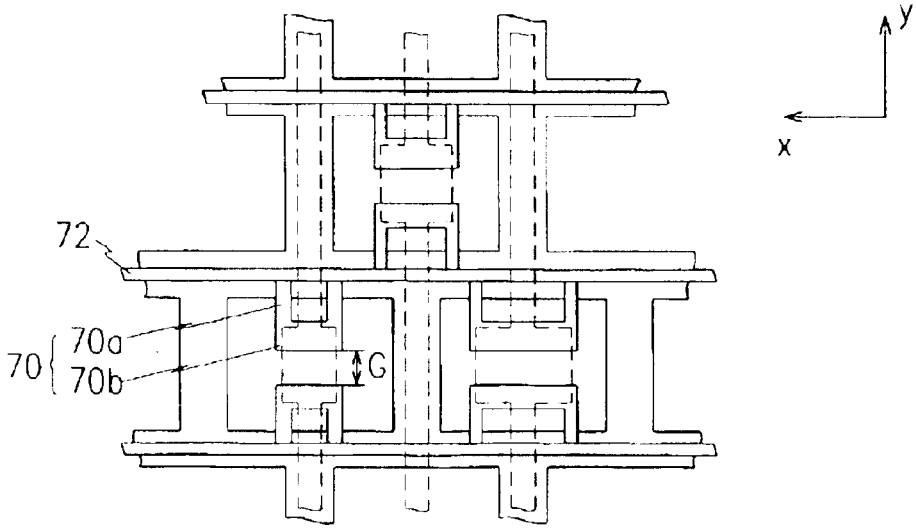

In another modified example, with reference to FIG. 12, branch electrode portions 70 include a pair of first electrode portions 70*a* that extend perpendicularly from main electrode portions 72 with a predetermined distance therebetween, and second electrode portions 70*b* that extend from one of pair of first electrode portions 70*a* to other of pair of first electrode portions 70*a* on distal ends of the same, so that a hole 70*c* having a predetermined size is formed into branch electrode 70, being surrounded by first electrode portions 70*a* and second electrode portions 70*b*.

Within one discharge space, a gap G is formed between two second electrode portions 70*b* extending into the discharge space from opposite directions, that is, from two different main electrode portions 72.

With the formation of the branch electrode portions of the sustain electrodes as in the above modified examples, a discharge efficiency of each discharge cell is improved and an address voltage margin is increased. Also, by further minimizing areas where branch electrode portions of the sustain electrodes oppose large electrode portions of address electrodes, the strength of unneeded reset discharge is reduced.

In addition, with respect to the structure of the branch electrode portions in the modified examples, since the absolute area of the sustain electrodes may be decreased while maintaining the same gap between two opposing branch electrode portions within one discharge space, power consumption is decreased during sustain discharge while the sustain discharge strength experiences almost no decrease such that the discharge efficiency is further improved.

In the PDP of the present invention structured and operating as described above, the address voltage margin is increased to make possible stable addressing. The reset discharge strength is reduced to improve contrast. The reset voltage is decreased to minimize the amount of power consumed.

Although embodiments of the present invention have been described in detail hereinabove, it should be clearly understood that many variations and/or modifications of the basic inventive concepts herein taught which may appear to those skilled in present art will still fall within spirit and scope of present invention, as defined in the appended claims.

What is claimed is:

1. A plasma display panel comprising:

a first substrate and a second substrate, the first substrate and the second substrate being provided with a predetermined gap therebetween;

barrier ribs formed between the first substrate and the second substrate, the barrier ribs defining a plurality of discharge spaces;

a plurality of address electrodes formed on the first substrate along a direction (y), the address electrodes being formed within and outside discharge spaces; and a plurality of sustain electrodes formed on the second substrate along a direction (x), sustain electrodes being formed within and outside the discharge spaces, wherein the address electrodes include:

large electrode portions provided within the discharge spaces; and small electrode portions provided outside the discharge spaces, wherein if a width of large electrode portion is AW, a width of small electrode portions is Aw, and a distance between barrier ribs along direction (x) is D, AW is larger than Aw, and AW is 40–75% of D.

2. The plasma display panel of claim 1, wherein the plurality of discharge spaces includes sets of R, G, and B discharge spaces, each set of R, G, and B discharge spaces being formed by the barrier ribs and arranged approximately in a triangular shape.

3. The plasma display panel of claim 2, wherein each of the R, G, and B discharge spaces is rectangular.

4. The plasma display panel of claim 2, wherein if widths of the large electrode portions of the address electrodes are $AW_R$, $AW_G$, and $AW_B$, $AW_R$, $AW_G$, and $AW_B$ satisfy the following condition: $AW_R<AW_G<AW_B$.

5. The plasma display panel of claim 1, wherein the large electrode portions are circular.

6. The plasma display panel of claim 1, wherein the large electrode portions are polygonal.

7. The plasma display panel of claim 2, wherein the sustain electrodes include:

main electrode portions formed following portions of the barrier ribs provided along the direction (x); and branch electrode portions formed extending from the main electrode portions and positioned within the R, G, and B discharge spaces.

8. The plasma display panel of claim 7, wherein if widths of branch electrode portions positioned within the R, G, and B discharge spaces are $SW_R$, $SW_G$, and $SW_B$, they satisfy the following condition:

$$SW_R<SW_G<SW_B.$$

9. The plasma display panel of claim 7, wherein if a width of branch electrode portions provided within the discharge spaces is SW, the following condition is satisfied:

$$AW=a\times SW(0<a<1).$$

10. The plasma display panel of claim 9, wherein (a) satisfies the following condition:

$$0.5<a<1.$$

11. The plasma display panel of claim 7, wherein if a width of branch electrode portions provided within the discharge spaces is SW, the following condition is satisfied:

$$AW=SW-b(0<b<SW).$$

12. The plasma display panel of claim 11, wherein (b) satisfies the following condition:

$$0\leqq b\leqq SW/2.$$

13. The plasma display panel of claim 7, wherein the branch electrode portions are rectangular.

14. The plasma display panel of claim 7, wherein the branch electrode portions include:

a first electrode portion extending perpendicularly from the main electrode portion; and a second electrode portion that enlarges on a distal end of the first electrode portion and extends parallel to the main electrode portion.

15. The plasma display panel of claim 7, wherein the branch electrode portions include:

a pair of first electrode portions that extend perpendicularly from the main electrode portions with a predetermined distance between the pair of first electrode portions; and a second electrode portion that extends from a distal end of one of the pair of first electrode portions to a distal end of the other of the pair of first electrode portion so that a hole having a predetermined size is formed by the main electrode portion, the pair of first electrode portions and the second electrode portion.

16. A plasma display panel comprising:

a first substrate and a second substrate, the first substrate and the second substrate being provided with a predetermined gap therebetween;

barrier ribs formed between the first substrate and the second substrate, the barrier ribs defining a plurality of discharge spaces, the plurality of discharge space including sets of discharge spaces being formed by the barrier ribs and arranged approximately in a triangular shape;

a plurality of address electrodes formed on the first substrate along a direction (y), the address electrodes being formed within and outside discharge spaces; and a plurality of sustain electrodes formed on the second substrate along a direction (x), sustain electrodes being formed within and outside the discharge spaces, wherein the address electrodes include:

large electrode portions provided within the discharge spaces, and small electrode portions provided outside the discharge spaces; and wherein the sustain electrodes include:

main electrode portions formed following portions of the barrier ribs provided along the direction (x), and branch electrode portions formed extending from the main electrode portions and positioned within the discharge spaces.

17. The plasma display panel of claim 16, wherein if a width of large electrode portions is AW, a width of small electrode portions is Aw, and a distance between barrier ribs along direction (x) is D, AW is larger than Aw, and AW is 40–75% of D.

18. The plasma display panel of claim 16, wherein the large electrode portions are rectangular.

19. The plasma display panel of claim 16, wherein the large electrode portions are circular.

20. The plasma display panel of claim 16, wherein the large electrode portions are polygonal.

21. The plasma display panel of claim 16, wherein if a width of branch electrode portions provided within the discharge spaces is SW, the following condition is satisfied:

$$AW=a\times SW(0<a\leqq 1).$$

22. The plasma display panel of claim 21, wherein (a) satisfies the following condition:

$$0.5\leqq a\leqq 1.$$

23. The plasma display panel of claim 16, wherein if a width of branch electrode portions provided within the discharge spaces is SW, the following condition is satisfied:

$$AW=SW-b(0\leqq b<SW).$$

24. The plasma display panel of claim 23, wherein (b) satisfies the following condition:

$$0\leqq b\leqq SW/2.$$

25. The plasma display panel of claim 16, wherein the branch electrode portions are rectangular.

26. The plasma display panel of claim 16, wherein the branch electrode portions include:

a first electrode portion extending perpendicularly from the main electrode portion; and a second electrode portion that enlarges on a distal end of the first electrode portion and extends parallel to the main electrode portion.

27. The plasma display panel of claim 16, wherein the branch electrode portions include:

a pair of first electrode portions that extend perpendicularly from the main electrode portions with a predetermined distance between the pair of first electrode portions; and a second electrode portion that extends from a distal end of one of the pair of first electrode portions to a distal end of the other of the pair of first electrode portion so that a hole having a predetermined size is formed by the main electrode portion, the pair of first electrode portions and the second electrode portion.

* * * * *

UNITED STATES PATENT AND TRADEMARK OFFICE

CERTIFICATE OF CORRECTION

PATENT NO. : 6,853,136 B2
DATED : February 8, 2005
INVENTOR(S) : Kim et al.

It is certified that error appears in the above-identified patent and that said Letters Patent is hereby corrected as shown below:

Column 10,
Line 5, delete "AW=axSW(0<a<1)", insert -- AW=aXSW(0<a≤1) --.
Line 10, delete "0.5<a<1", insert -- 0.5≤a≤1 --.
Line 16, delete "AW=SW-b(0<*b*<*SW*)", insert -- AW=SW-b(0≤b<SW) --.
Line 40, delete "portion", insert -- portions --.
Line 50, delete "space", insert -- spaces --.

Column 11,
Line 19, delete "AW=axSW(0<a≦1)", insert -- AW=aXSW(0<a≤1) --.

Column 12,
Line 23, delete "portion", insert -- portions --.

Signed and Sealed this

Twenty-ninth Day of November, 2005

JON W. DUDAS
*Director of the United States Patent and Trademark Office*